US007495576B2

(12) United States Patent
Maskeny et al.

(10) Patent No.: US 7,495,576 B2
(45) Date of Patent: Feb. 24, 2009

(54) MODULAR ELECTRONIC SIGN AND METHOD OF ASSIGNING A UNIQUE IDENTIFIER TO COMMON MODULES OF SAID SIGN

(76) Inventors: Donald D Maskeny, 12650 SE. 77th St., Morriston, FL (US) 32668; Jeffery L West, 2035 Philippe Pkwy., Area-51, Safety Harbor, FL (US) 34695

( * ) Notice: Subject to any disclaimer, the term of this patent is extended or adjusted under 35 U.S.C. 154(b) by 335 days.

(21) Appl. No.: 11/460,972

(22) Filed: Jul. 29, 2006

(65) Prior Publication Data

US 2008/0024387 A1 Jan. 31, 2008

(51) Int. Cl.
*G08B 5/22* (2006.01)

(52) U.S. Cl. ..... 340/815.45; 340/815.4; 340/815.42; 340/907; 345/1.1; 345/46; 345/55; 345/82; 345/204

(58) Field of Classification Search ..... 340/815.45, 340/815.4, 815.42, 907; 345/1.1, 82, 46, 345/244, 55, 204
See application file for complete search history.

(56) References Cited

U.S. PATENT DOCUMENTS 5,394,165 A 2/1995 Sugiura
5,410,328 A 4/1995 Yoksza et al.
5,450,301 A 9/1995 Waltz et al.
5,796,376 A 8/1998 Banks
5,990,802 A * 11/1999 Maskeny ..... 340/815.45
6,314,669 B1 * 11/2001 Tucker ..... 40/448
6,414,650 B1 * 7/2002 Nicholson et al. ..... 345/1.1
6,791,513 B2 * 9/2004 Ogino et al. ..... 345/55
7,064,673 B1 * 6/2006 Bonham ..... 340/815.4

* cited by examiner

*Primary Examiner*—Davetta W Goins
(74) *Attorney, Agent, or Firm*—James E. Larson

(57) ABSTRACT

A plurality of common, modular panels attach to a support frame carrying power and data connections for an electronic display sign. LEDs are used as the light mechanisms for illumination of said sign. Each modular panel is under separate microcontroller control and includes its own on-board memory. The electronic display sign includes a master control element that connects to a PC or laptop computer for loading data or programs into the memory of each modular board. The master control sends out commands or data that is interrogated by every microcontroller on each modular panel of the entire sign such that only the panel with a unique identification number will process data intended therefore. The on-board memory allows for the creation of a virtual screen such that each modular panel of the entire sign is rendering the entire message being displayed on said sign even though each modular panel may only be actually illuminating a portion of said message on the LEDs of each panel. A novel auto-baud scheme re-sets the baud rate for the sign for each packet of data received. A novel identifier assignment scheme allows the end user to assign serial numbers to each panel after the sign is attached to the support frame.

15 Claims, 5 Drawing Sheets

MODULAR ELECTRONIC SIGN AND METHOD OF ASSIGNING A UNIQUE IDENTIFIER TO COMMON MODULES OF SAID SIGN

BACKGROUND OF THE INVENTION

1. Field of Invention

The present invention relates to electronic sign, display and messaging systems. More particularly, it relates to a modular system having a plurality of identical modular panels forming a larger display matrix, each modular panel being under microprocessor control for selecting information for its respective module from a single, common serial data transmission line; each module microprocessor having read only memory for storing previously loaded data, temporary random access memory for retaining "virtual screen" data and computational abilities for facilitating the manipulation of said virtual screen data utilizing said previously loaded and stored data; each modular panel being able to accept a unique identifier through a method of assigning said identifier.

2. Description of the Prior Art

Electronic message and display systems are well known in the prior art. They first appeared outside of banks displaying the temperature and time for passing motorists and pedestrians. These simple electronic displays typically used LEDs and were sometimes microprocessor controlled, but they did not require sophisticated circuitry since there only function was to alternate the current temperature and local time. Accordingly, issues of loading and displaying the "image" quickly were not a factor, nor was there a desire to move the image around the display system (i.e., scrolling).

Soon however, other uses emerged. Store owners, for example, began to display other information such as a notice of sale or other "eye-catching" information that they wanted the public to know. Accordingly, electronic message and display systems began to be used as an important advertising tool and information disseminator. Because of this, a need arose to load the messages more quickly and to have abilities to do things such as scrolling. To accomplish this, more sophisticated circuitry was needed. A good modern day example of the need to load a message quickly is the display systems that are used along highways and major traffic corridors for publishing "Amber Alerts."

Early sophisticated electronic message and display systems were controlled by a single computing device and require complicated interconnected electronic circuitry to control the entire display. As a result, these types of boards where costly to manufacture, difficult to fix and caused long delays during maintenance and repairs. For example, if only a portion of the board was malfunctioning, then the entire display system had to be taken "off-line" to be repaired. In other words, a single LED failure could cause total display system failure. More complicated electronic circuitry was needed to bring these electronic message and display systems to modern day standards where people expected their messages (or animation) to be quickly loaded and shown and the display system to remain functioning even if a portion of the system failed. Further advancements were clearly needed.

It was therefore proposed, that an entire display system could be made up of individual smaller display panels. Such smaller display panels were "modular" and allowed for interconnection there between. These modular display systems were easier to manufacture and allowed for customer driven design. Such a modular system can be seen in U.S. Pat. No. 5,450,301 to Waltz et al. However, Waltz et al. did not teach the use of individual computer control of each modular panel.

Accordingly, many of the inherent difficulties experienced in the prior art remained in early modular system designs. And, those that did contemplate individual panel computer control produced extremely complicated networks of circuitry wherein intricate wiring, application specific components and computer architecture was the norm. No one contemplated building from simple uniformed modular building blocks (i.e., panels). This in turn, prohibited vendors from stocking any inventory of building block type modular panels that would allow for cost effective, quick and final construction and installation of electronic message and display systems. Improvement was clearly still needed.

U.S. Pat. No. 5,990,802 to Maskeny improved greatly upon the art of modular electronic message and display systems. In particular, Maskeny advanced a system wherein a plurality of identical modular panels made up a large display system or matrix. The entire matrix is under computer control wherein individual display chips (microprocessors) are mounted on each panel. The display chips drive the illumination elements or LEDs. A three wire connection couples a host computer and a power supply to the entire display matrix, regardless of the number of modular panels that makes up the display panel matrix (the electronic sign). Two of the wires attend to a positive DC voltage and ground while the third wire transmits all serial data that is supplied to the display matrix. The panels attach to a mechanical support frame that carries the power and data connections to each panel and hence the entire sign. A unique addressable serial data selection and distribution means provides for the ability for all data that is carried over the single serial data wire to be received by each and every display chip but only loaded, and subsequently shown, by the display chip (and therefore the modular panel) that has such unique address. This was a significant improvement in the art. Before the Maskeny invention, individual data wires were needed to address each modular panel, thereby providing for a very complicated circuitry system. No ability existed here before, that allowed each display chip to look at all of the data that passed by, ignore data not intended to be received and only display intended data. However, even in this improvement, each modular panel was part of the greater display matrix. It is not contemplated in Maskeny that each modular panel, in itself, could carry an entire message or animated scene in memory that is intended to be shown on the entire display matrix. In other words, each modular panel, although under individual microprocessor control, still has a level of dependency on the other modular panels in the display matrix. This dependency among the modular panels can effect message loading and display speeds.

As any art progresses, new uses are desired and so new advancements are needed. In the prior art of modular electronic message and display systems, many new uses and features are desired. In particular, users of these display systems desire a quicker loading scheme so they can change the message they are displaying more often, without affecting overall display time of the system. Further, end users such as store owners desire the ability to create and load their own messages, using a computer, without the need to have a specialized technician or operator visit their location and create the message. Further, users want their messages to do more. For example, they desire the ability to scroll their messages in a multitude of different directions and patterns. Or, they want to show a more complicated graphic that rises to the level of animation. Still further, users want the ability to repair their own display systems without the need to bring in a specialized and costly technician. They do not want their message or animation affected by the replacement of a new modular panel. For example, in display systems that use the unique addressable serial data selection and distribution means, replacement of one panel in an entire display matrix requires the re-programming (updating) of the message so that the data that forms such message knows the new unique serial number of the display chip for the new replaced panel. In total, users want significantly advanced features on electronic message and displays systems that are easier to operate and contain less circuitry. And, they want all of these new features and abilities at a reduced cost. Nothing in the prior art satisfies this need completely in one system. The prior art can only satisfy some of these needs individually and at the expense of complicated, highly sophisticated electronic circuitry at a greater cost. Further, some of these needs can only be satisfied with highly tuned, extremely fast, high speed hardware, that requires highly trained technical professionals to install and/or repair such systems.

SUMMARY OF THE INVENTION

We have invented an improved modular LED messaging display panel for use in a larger display sign matrix that addresses all of the deficiencies in the prior art. Our system incorporates a three wire electrical connection between a host and the sign matrix. All data for each modular panel of the sign matrix is transmitted over a single serial data line and addresses separate microcontrollers on each modular panel. A slow data rate can be used and therefore each modular panel is devoid of any crystal control. This translates into a less complicated and therefore less expensive system for the end user. The support frame to which the modular panels attach carry the power and data connections. By attaching the modular panels to the support frame, all connections are made.

EROM and RAM are included with each microcontroller and therefore each modular panel of the larger sign matrix has its own "on-board" memory and control that assists in providing solutions to the deficiencies in the prior art and providing the desired needs to the end users. In particular, our electronic sign utilizing individual modular display boards having on-board memory and control can simulate a "virtual screen" by having each panel render the entire message or animation on each modular panel in its virtual screen, but only show a particular portion of said message or animation on the particular panel for the actual display matrix based upon a panel identification number (i.e., location). This permits us to show animation and messages more quickly due to pre-loading of data and character sets into EROM. Further, because of the on-board memory, more data can be loaded and accordingly, more sophisticated animation can be displayed, but without the need to add additional complicated electronic circuitry. Still further, on-board memory allows for pre-loading of data which frees up more time for actual showing of display data (messages). Yet even further, the on-board memory permits simultaneously loading and showing. And yet even further, the on-board microcontroller and memory reduces the host function during show or display, making it a minimally active host. The on-board memory allows for collection and storage of data (frames) prior to showing. Therefore, global frame "cadences" (or sequences) can be sent out along the single serial data line to show the message, animation or graphic. The cadence or sequence is a user defined order of frame display.

Other advancements include the ability for the end user to assign a "customer defined" serial number to each modular panel at the time of panel connection to the support frame. The end user can also change the serial number at his discretion or assign new serial numbers to panels if they are replaced. Also, a novel auto-baud protocol is used to set the baud rate (bit rate) for the transmission of every packet of data. Accordingly, the sign is not hampered by the confines of a pre-determined baud rate.

A first object of the present invention is therefore to provide for on-board control and memory for each modular panel of an LED messaging display sign matrix.

A further object of the present invention is to provide for quicker loading and showing of messages through the use of on-board memory.

Another object of the present invention is to provide for end user computer control of the message or animation programming.

Still another object of the present invention is to provide for preloading of character sets in the on-board memory for subsequent displaying.

Yet another object of the present invention is to provide for the ability to load and show a message at the same time through a cadence control scheme that controls timing of the entire message display sign.

Another object of the present invention is to provide a virtual screen for the display sign matrix such that each modular panel is displaying the entire message or animation in its respective on-board memory even through each modular panel may only be visually showing a smaller portion of the message or animation at any given time during the display of the message or animation on the actual message display sign matrix.

Still another object of the present invention is to provide a means for installing, repairing and replacing one or more panels in a display matrix through "Point and Click" panel identification of a particular microprocessor assigned to said panel.

And another object of the present invention is to provide a display sign matrix that executes complicated pattern movement of the message or animation (such as scrolling) through the use of the modular panel on-board control and memory.

Another object of the present invention is to provide a display sign matrix having advanced features that satisfies all of the desired needs of the end user but has minimally complex circuitry that is offered to end users at a reduced cost.

And still another object of the present invention is to provide a display sign matrix made up of modular panels that receive their commands and data over a single serial data wire using a unique auto-baud scheme to set the baud rate of the sign for every burst of data.

BRIEF DESCRIPTION OF THE DRAWINGS

The detailed description of the invention, contained herein below, may be better understood when accompanied by a brief description of the drawings, wherein.

DETAILED DESCRIPTION OF THE PREFERRED EMBODIMENT

The present invention relates to a message display sign that is formed by identical interconnected modular panels as seen in U.S. Pat. No. 5,990,802 and is accordingly, incorporated herein by reference. A message display sign of this type utilizes a single serial data line connected to a host to transmit data to each panel of said sign. Each panel has its own microcontroller with a unique identifier (or ID). The data being sent is coded such that each microcontroller interrogates every packet of data, ignores the data not intended to be received by said respective microcontroller (and therefore said respective modular panel) and loads only that data intended for said respective microcontroller and therefore said respective panel. Accordingly, the message display sign of the present invention utilizes a uniquely addressable serial data selection and distribution means to display a message, animation or graphic.

Figure 3:
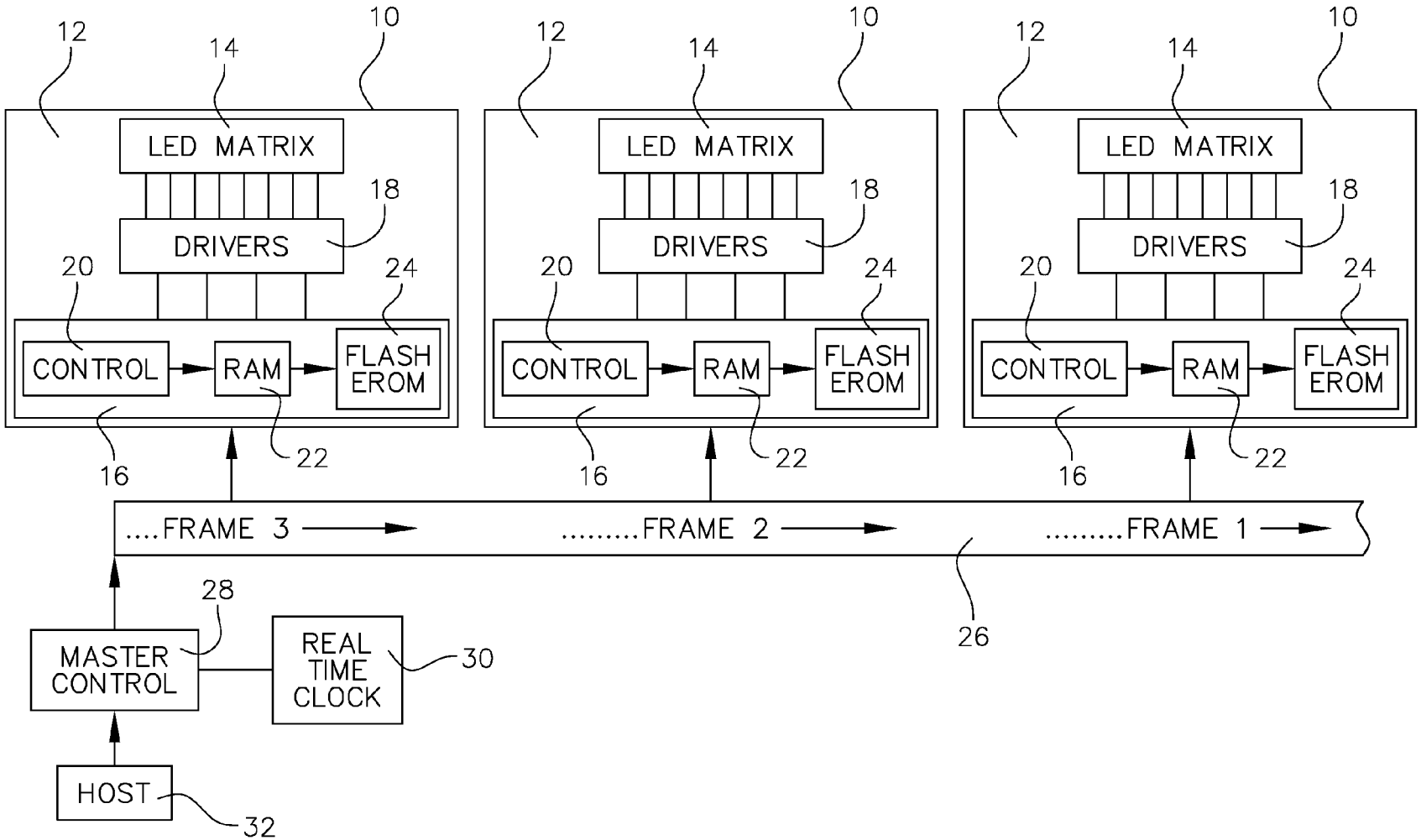
FIG. 3 is a block diagram illustrating modular panels of a message display sign of the present invention which are coupled to a host controller that sends data along a single serial data line to said modular panels wherein different commands and data can be contained in said data transmitted there along.

With reference now to FIG. 3, which particularly distinguishes the message display sign of the present invention from all of those in the prior art including that which is described in U.S. Pat. No. 5,990,802, modular panels 10 are shown wherein each panel 10 includes a circuit board 12 having an LED matrix 14, a microprocessor 16 and an LED driver 18. In the preferred embodiment, common anode (or common positive) drivers are employed for LED driver 18.

Microprocessor 16 includes a control mechanism 20, random access memory (RAM) 22 and erasable read only memory (Flash/EROM) 24. Each modular panel 10 is a single unit (one module) of a larger display sign. Each modular panel 10 is connected to a common serial data line 26. A master control 28 is connected to serial data line 26 and acts as a pipeline or relay between the sign and a host 32. In the preferred embodiment, host 32 is a PC or laptop computer. Host 32 is only needed to modify or change the message, animation or graphic. Therefore, host 32 can be disconnected from master control 28 once a message is loaded. Master control 28 is coupled to or has an internal real time clock 30. Real time clock 30 allows for the scheduling or playing of different messages based upon previously determined time and/or days without re-connecting to host 32.

With continuing reference to FIG. 3, it is shown that host 32 instructs master control 28 to send data along serial data line 26 such that each and every modular panel 10 receives and interrogates the data and makes a decision on what to do with said data. If the data contains a unique identification (an address) that corresponds to a unique identification serial number assigned to the respective panel, then that data will be accepted by the respective panel and used to illuminate LEDs on LED matrix 14 that corresponds to a message, animation or a graphic that is programmed for display on said sign, or within EROM or stored in RAM.

Data is transmitted along serial data line 26 in frame numbers, as shown in FIG. 3. Different types of commands can be contained in the frame numbers transmitted along serial data line 26 and include Load Frame Data, Frame Display Commands and Frame Manipulation Commands.

Load Frame Data is panel specific and includes commands that loads character sets (i.e., ASCIT), pictures, animation or images (to name just a few examples) into Flash EROM 24 for each panel. Accordingly, host 32, through master control 28, can send the ASCIT character set to a panel 10 having a serial number (ID) of 0007, for example, in a display sign having twenty panels with ID numbers of 0000-0019 simply by coding such data with said serial number 0007. Each panel of the display sign will interrogate (look at) the data since it is transmitted along serial data line 26, but only the panel having ID 0007 will load such data into EROM 24.

Frame Display Commands can be panel specific or be a global command that addresses the entire sign. For example, a Frame Display Command can be "rotate" wherein a displayed message scrolls across the matrix.

Frame Manipulation Command can also be panel specific or global. Frame Manipulation Commands can therefore show graphics or animation on the actual sign or work to manipulate and/or control a "Virtual Screen" to be discussed in more detail hereinafter. In the preferred embodiment, a sequence of Frame Manipulation Commands can be preprogrammed into sequences up to 127 steps of which there can be 99. Larger "on-board" memory configurations could allow even a larger number of messages than 99 wherein there can be more than 127 steps for each message.

Master control 28 keeps all on-board controllers 20 on the same pulse or same step by calling out a sequence or cadence of frame number for the sign, as depicted in FIG. 3 wherein the cadence has begun with Frame 1, Frame 2, and Frame 3. As mentioned before, each frame can be a graphic image, or a character. However, the frame can also be a program initiated to manipulate the status of the on-board microcontroller and memory. On-board microcontrollers 16 allow for tasks such as frame changes and frame manipulations to be done at the modular level instead of at the master control 28 or host 32 level as in the prior art.

In the preferred embodiment, 8 bit SIPO (serial in, parallel out) data is employed. However, nothing herein limits the use of 16 or 32 bit data. The four vertical lines from microprocessor 16, shown on FIG. 3, represent Data, Clock, Strobe and Enable. Further, eight parallel outputs are employed from drivers 18. This represents the use of an 8×8 LED matrix. However, LED matrixes of other configurations can be employed and include 8×16, 8×24 and 8×32. In such embodiments, such as an 8×16 LED matrix, sixteen outputs would be used and therefore be shown.

A typical command such as "Load" contains 72 bytes of data including two bytes for the command itself, two bytes for the ID of the panel, two bytes for the frame number which looks to EROM 24, sixty-four bytes of frame data which also looks to EROM 24 and two bytes for a checksum.

With continuing reference to FIG. 3, it is depicted that Frame 1, then Frame 2, then Frame 3 are being transmitted along serial data line 26. However, since the Frame commands can include a plurality of different data or commands, nothing herein limits the frame numbers from being sent in a sequential or non-sequential order. Accordingly, any desired sequence of frame numbers can be transmitted along serial data line 26 by the end user in control of host 32. Further, since global commands can be sent to the sign, such as "Frame 1" being a command that addresses all modular panels of the matrix, greater display speeds are realized with significantly less complicated circuitry than that of the prior art.

Figure 1:
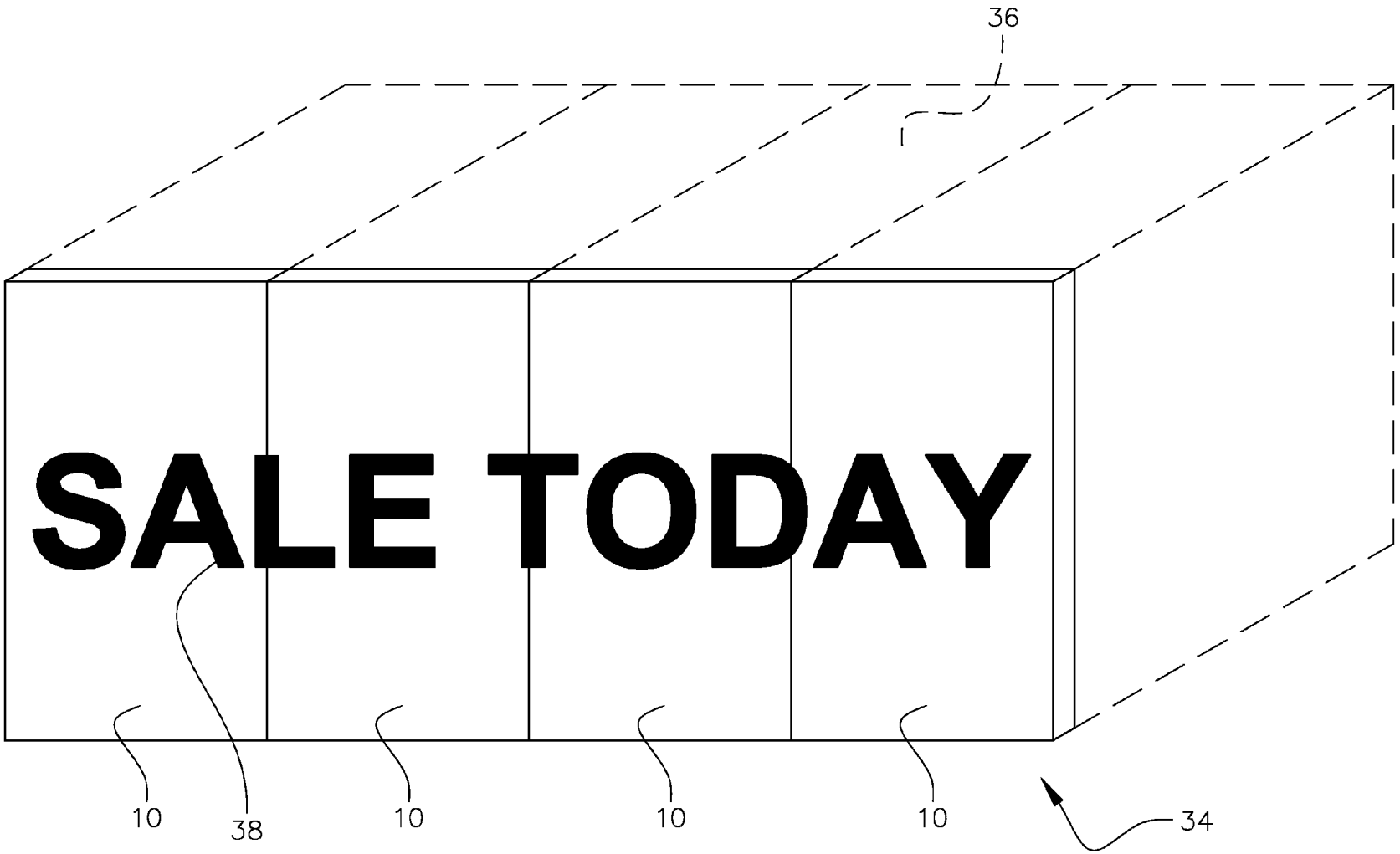
FIG. 1 is a perspective view of a message display sign utilizing modular panels of the present invention, said message display sign having a virtual screen s represented by dashed lines thereon.
Figure 2:
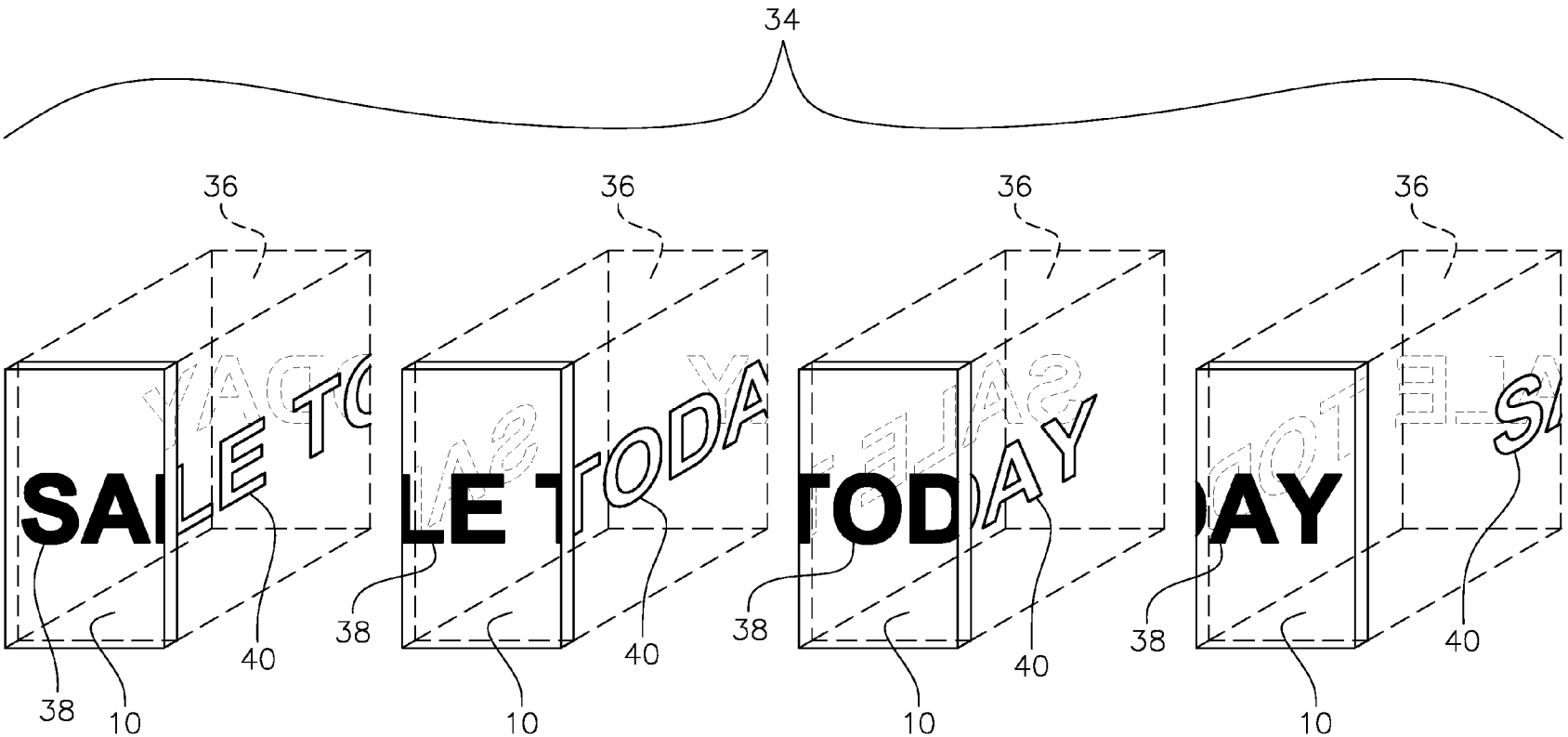
FIG. 2 is an exploded view of the invention depicted in FIG. 1 wherein the virtual screen is once again represented by the dashed lines and wherein it is shown that a message to be displayed on said sign with said virtual screen is fully rendered on each modular panel even though at any given time only a portion of said message is displayed on an LED matrix on each modular panel of said sign.

Referring now to FIGS. 1 and 2, an electronic display sign 34 of the present invention is shown having a plurality of modular panels 10. Panels 10 are attached to a support frame (not shown) that supplies power, ground and the single serial data wire connection. As previously described, each panel 10 has on-board RAM 22 (see FIG. 3) which allows sign 34 to create a virtual screen 36. Virtual screen 36 is not visible to the human eye but it renders graphics, animation, messages and characters that master control 28 commands it to do. Such rendering is done in RAM 22 and is therefore readably available for viewing on LED matrixes 14 of each panel 10 that form display signs 34. As shown in FIG. 1, a message 38 is displayed across sign 34 wherein each modular panel 10 contributes to the rendering (displaying) of the total message 38. In this example, four panels 10 are employed in sign 34 and the message 38 reads "SALE TODAY". As shown in the exploded view of FIG. 2 however, message 38 is actually rendered in it's entirety in each modular panel 10. However, the portions 40 of message 38 that are not part of the LED matrixes 14 that are visible to the human eye are rendered on virtual screen 36. Accordingly, the physical screen (that which the human eye can see) is defined by the number of LEDs on a particular panel 10 whereas the virtual screen 36 is defined by the information being displayed on all modular panels 10. The ID number of a specific modular panel 10 indicates what portion of virtual screen 36 will be rendered on its respective LED matrix 14 to display message 38.

In the preferred embodiment, virtual screen 36 is defined as 256×64 dots of LEDs regardless of how many panels 1 are used and what sized panels 10 are employed. A physical screen, on the other hand, is defined by the actual number of LEDs. For example, if sign 34 was formed from eight panels, two rows of four, that are horizontally disposed, and the panels are 8×24, then the sign would be (8×2=16) 16 dots tall and (24×4=96) 96 dots wide.

As mentioned before sign 34 formed from modular panels 10 are all interconnected by a single serial data line 26. Timing errors are very important in any electronic sign and it is no different in the present invention wherein all data is transmitted over single serial data line 26. A timing error can result in a framing error (sampling within the wrong bit) which translates to the sign getting confused about what it is to display. However, no crystals are employed to maintain timing in the present system. Instead, a novel "auto-baud" protocol is run during every burst (packet) of data along serial data line 26.

It must first be appreciated that there is a microcontroller 16 on every modular panel 10 that must maintain an accurate baud rate in relation to all other microcontrollers 16 and the master control 28 so that sign 34 displays the proper message 38 and in the right form. But, it is understood that identical microcontrollers 16 can "drift" or count slightly faster or slower than one another. Over time, without proper resetting, this drift causes problems like a framing error. According, there must be a timing mechanism or protocol used to keep the system tuned.

Figure 4:
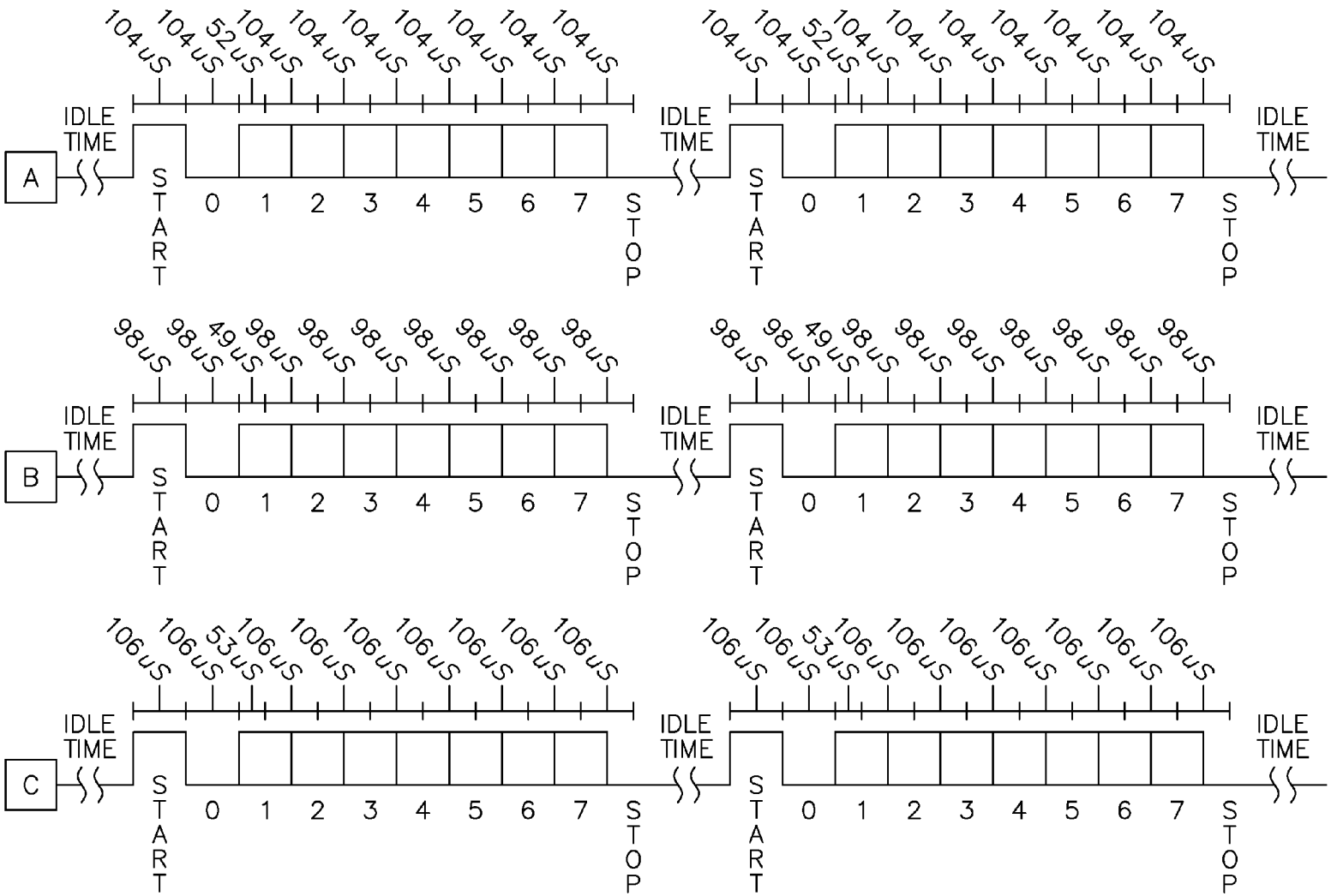
FIG. 4 is a diagram illustrating an auto-baud protocol used in maintaining the timing and synchronization of messages being displayed on the message display sign of the present invention.

Referring to FIG. 4, it is shown that the present invention uses a novel auto-baud timing protocol. FIG. 4 illustrates three separate controllers 16 (A, B and C) on three separate modular panels 10 receiving the same frame command or frame data, as an example of how auto-baud works. It is illustrated (by example) that each microcontroller A, B and C counts the baud rate (duration) of the Start bit at a different rate. Microcontroller A counts the Start bit as being 104 us. Microcontroller B counts the Start bit as being 98 us. And, microcontroller C counts the Start bit as being 106 us. After a period of idle time, counting begins when the single serial data line goes high. Counting ends when the single serial data line goes low or at the beginning of the "0" bit. Thereafter, each microcontroller counts the value they established during the Start bit again, which takes each microcontroller through to the end of the "0" bit. The microcontrollers are not concerned whether the line goes high or low as bit "1". Thereafter, the auto-baud protocol now counts half of its established value or 52 us for microcontroller A, 49 us for microcontroller B and 53 us for microcontroller C and sample bit "1" halfway through said bit. Then, each microcontroller counts its originally established value and samples the line to see whether it is high or low, thereby always sampling the line in the middle of the bit of data and establishing a cohesive baud rate for that packet of data for all microcontrollers. Each microcontroller is not concerned with the baud rate (counting value) of the others, since microcontroller A's rate of 104 us for one bit of data in the packet is equal to microcontroller B's rate of 98 us which in turn is equal to microcontroller C's rate of 106 us. In other words, each microcontroller is going to react to the same change in state of the data bit and sample at the identical time, even though each microcontroller may be using a different value (baud-rate) to decide when to make such sample. Also, since RS-232 is being used in the present invention, a high value is always send to the first bit (bit "0"), which means the state will always be low and hence the auto-baud protocol can extract the baud rate from said Start bit, since the Start bit will be high and bit "0" will be low. To ensure that bit "0" will be low, an odd number is sent as the first byte in each packet.

There are many advantages to the auto-baud protocol. First, the system is not regulated by a "set" (pre-determined) baud rate. Auto-baud is dynamic and can change with changing circumstances. For instance, there could be noise in the system that requires running the system at a slower baud rate. Let's say that the system is currently running at 128 kbs. The next available slower "set" baud rate is 56 kbs. However, maybe the system could run find at 104 kbs. Auto-baud allows you to use non-standard baud rates. Further, if the host changes rate, the microcontrollers on each modular panel will adjust accordingly, since the rate is re-determined at the first bit of the first byte of every packet of data that is transmitted. Still further, there is no need for any other timing components which reduces complexity and thereby reduces cost. And still further, any drift that does occur becomes negligent since it is "corrected" on the very next packet of data.

Figure 5:
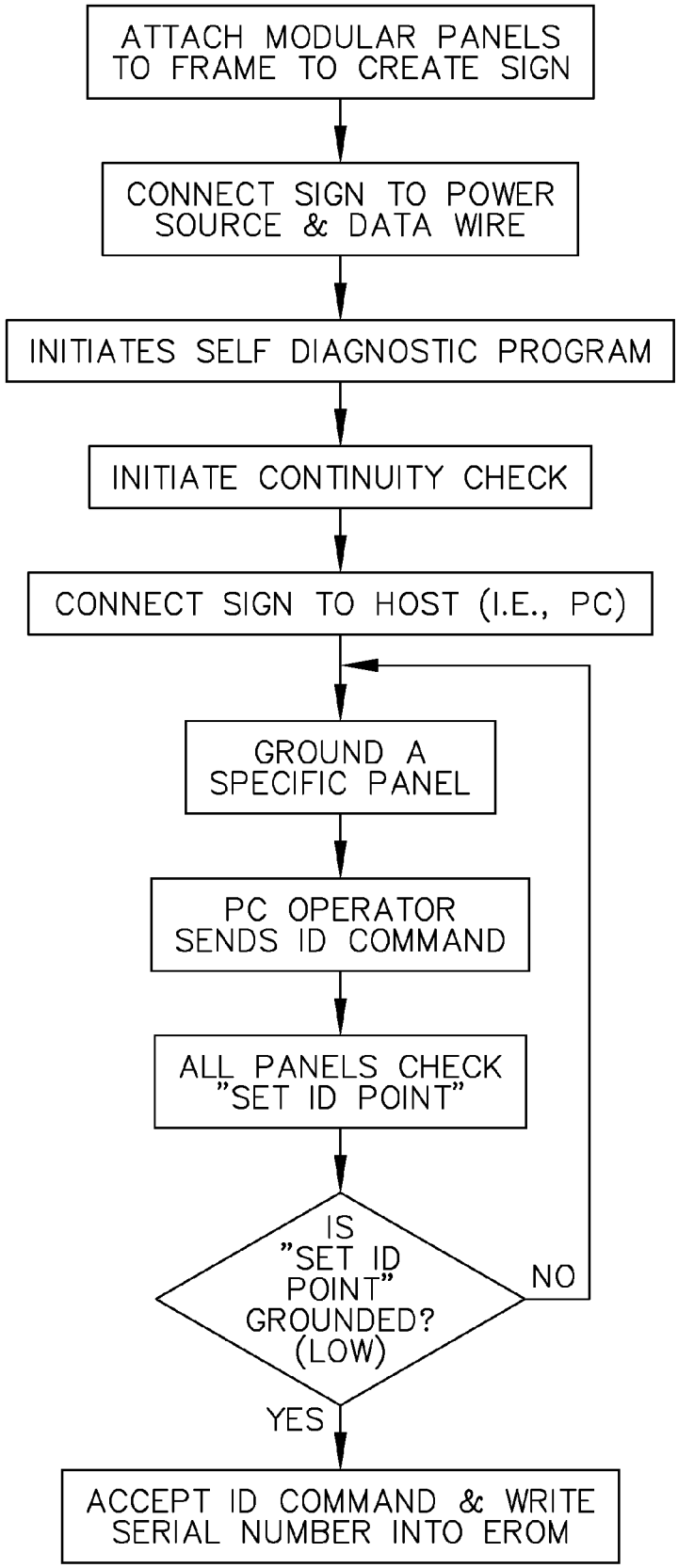
FIG. 5 is a block diagram illustrating the steps of a method used to set unique identification number to common (identical) modular panels used in a message display sign of the present invention.

Referring now to FIG. 5, a method of assigning serial numbers to the modular panels of an electronic sign of the present invention is shown, a so called "Point and Click" procedure. As illustrated, the modular panels are first attached to a support frame. In the preferred embodiment, the support frame provides the power and data line connections. Accordingly, when attached, the next step is concluded, which is connecting the sign to the power source and single serial data wire. By attaching to the support frame and providing power, a self-diagnostic program is initiated. This self-diagnostic program will continue to run so long as the data wire stays high or there is no data wire connection. During the self-diagnostic test (which continues until power is removed or the data line goes low), every other LED on the LED matrix will illuminate, then all other LEDs that didn't light before will illuminate, and then a serial number of 0000 will flash on. The next step is to initiate a continuity check. This is done by grounding the data wire which should make all modular panels go blank. If any panel does not go blank, that is an indicator that the data wire or power connection is not properly connected to that specific panel. Once continuity is established, the sign is connected to master control 28, which in turn is connected to host 32, such as a PC or laptop computer.

At this point, serial numbers can be assigned to each panel. This is done by having a person physically ground one panel. Thereafter the host operator (PC operator) sends an ID command to the sign. This is done by clicking the cursor in the appropriate position with a mouse connected to the PC on a grid displayed on a screen of the PC, representative of the sign. All panels check a "set ID point" by asking "is the set ID point low (grounded) ?" If the answer is yes, then the ID command is accepted and the serial number is written into EROM. If no, then the panels do nothing. This procedure is repeated until all panels are sequentially numbered from 0000 to a number representing the last panel (i.e., if 30 panels are used, the last panel is 0029). Since the serial number is written into EROM, it can be changed at user's discretion.

Equivalent elements can be substituted for ones set forth herein to achieve the same results in the same way and in the same manner. Further, equivalent steps for assigning serial numbers to the panels can be substituted for the ones set forth to achieve the same method in the same way and in the same manner.

Having thus described the present invention in the detailed description of the preferred embodiment, what is desired to be obtained in Letters Patent is:

1. An electronic messaging display sign including at least one modular panel, each at least one modular panel comprising:

a) an electrical circuit board;

b) a plurality of lights coupled to said circuit board;

c) a microcontroller coupled to said circuit board for receiving data from a master control and illuminating said plurality of lights through a driver element based on said data through a driver element, the microcontroller including a control mechanism and memory, the master control common to each of said at least one modular panel;

d) a power source;

e) a single serial data wire for connection to said at least one modular panel, the single serial data wire transmitting said data from said master control to said at least one modular panel to display a message on said electronic messaging display sign;

f) the data received by said microcontroller of said at least one modular panel transmitted in frames; and g) the frames including character sets, picture data, animation, load frame data, frame display commands and frame manipulation commands.

2. The electronic messaging display sign of claim 1, wherein the memory comprises EROM and RAM.

3. The electronic messaging display sign of claim 1, wherein the power source and single serial data wire are provided on a support frame to which said at least one modular panel attaches.

4. The electronic messaging display sign of claim 1, wherein the at least one modular panel comprises a plurality of modular panels, each of said plurality of modular panels having an uniquely assignable serial number distinguishing each modular panel from all others of said electronic messaging display sign.

5. The electronic messaging display sign of claim 4, wherein said uniquely assignable serial number is stored in said memory of said microcontroller for each of said plurality of modular panels.

6. The electronic messaging display sign of claim 5, wherein specifically directed data of said transmitted data along said single serial data wire is received by a specific modular panel of said plurality of modular panels based upon an address within said specifically directed data that equates to a particular uniquely assignable serial number of said panel.

7. The electronic messaging display sign of claim 4, wherein the uniquely assignable serial number is re-assignable.

8. The electronic messaging display sign of claim 1, further comprising a virtual screen created by said memory of said at least one modular panel, the virtual screen rendering a complete message in response to said at least one modular panel receiving said data from said master control even though said plurality of lights of said at least one modular panel is rendering only a portion of said complete message.

9. The electronic messaging display sign of claim 1, wherein the plurality of lights are LEDs.

10. An electronic messaging display sign including at least one modular panel, each at least one modular panel comprising:

a) an electrical circuit board;

b) a plurality of lights coupled to said circuit board;

c) a microcontroller coupled to said circuit board for receiving data from a master control and illuminating said plurality of lights through a driver element based on said data through a driver element, the microcontroller including a control mechanism and memory, the master control common to each of said at least one modular panel;

d) a power source;

e) a single serial data wire for connection to said at least one modular panel, the single serial data wire transmitting said data from said master control to said at least one modular panel to display a message on said electronic messaging display sign; and f) the data comprising a plurality of data packets, each data packet establishing a baud rate for said sign during reception of each data packet of said plurality of data packets.

11. The electronic messaging display sign of claim 10, wherein a first data bit for every byte of said plurality of data packets has a low value.

12. The electronic messaging display sign of claim 11, wherein a duration value of a start bit for each byte of data for said plurality of data packets is established and half its value is used to decide when a sample is taken in a second data bit regardless of state of said second data bit.

13. The electronic messaging display sign of claim 12, wherein all remaining data bits after said second data bit are sampled after a duration of time elapses which is equal to said duration of said start bit.

14. An electronic messaging display sign system comprising:

a) a plurality of modular panels attached to a support frame, said support frame providing a power and ground connection and a single serial data wire for interconnecting all of said plurality of modular panels along a common data pathway;

b) a master control element;

c) each of said plurality of modular panels having a microcontroller, memory, a plurality of illumination elements and drivers for acting upon said illumination elements in response to data or commands received by said microcontroller along said single serial data wire from said master control;

d) each of said microcontrollers having a uniquely addressable serial number for accepting specific data of said data transmitted from said master control intended for a particular modular panel based upon said serial number;

e) the data received by each of said microcontrollers of said plurality of modular panel transmitted in frames; and f) the frames including character sets, picture data, animation, load frame data, frame display commands and frame manipulation commands.

15. The electronic messaging display sign system of claim 14, further comprising a virtual screen created by said memory of said plurality of modular panels, the virtual screen rendering a complete message in response to said plurality of modular panels receiving said data from said master control even though said plurality of illumination elements are rendering only a portion of said complete message.

* * * * *